US005186076A

United States Patent [19]

Kataumi et al.

[11] Patent Number: 5,186,076

[45] Date of Patent: Feb. 16, 1993

[54] VIBRATION PROOFING STRUCTURE OF PEDAL FOR VEHICLE

[75] Inventors: Yoshimasa Kataumi; Yoshinobu Kondo, both of Kosai, Japan

[73] Assignee: Fuji Kiko Company, Limited, Japan

[21] Appl. No.: 557,645

[22] Filed: Jul. 26, 1990

[30] Foreign Application Priority Data

Jul. 27, 1989 [JP] Japan ..... 1-88477[U]

[51] Int. Cl.[5] ..... G05G 1/14

[52] U.S. Cl. ..... 74/560; 74/563; 74/594.4

[58] Field of Search ..... 74/594.4, 594.5, 594.6, 74/560, 563

[56] References Cited

U.S. PATENT DOCUMENTS

| | | | |
|---|---|---|---|
| 1,455,675 | 5/1923 | Sinclair | 74/563 |
| 2,267,171 | 12/1941 | Rubissow . | |
| 3,097,542 | 7/1963 | Chayne | 74/560 |
| 3,715,934 | 2/1973 | Reed | 74/560 |
| 3,859,867 | 1/1975 | Haines et al. | 74/563 |
| 4,084,561 | 4/1978 | Miller | 74/560 X |
| 4,421,291 | 12/1983 | Schluchter et al. . | |
| 4,800,773 | 1/1989 | Nakamura et al. . | |
| 4,873,890 | 10/1989 | Nagano | 74/560 X |
| 4,899,614 | 2/1990 | Kataumi | 74/563 X |
| 4,947,708 | 8/1990 | Lacombe | 74/594.4 X |

FOREIGN PATENT DOCUMENTS

| | | | |
|---|---|---|---|
| 0021517 | 6/1980 | European Pat. Off. . | |
| 2240480 | 11/1975 | France | 75/560 |

*Primary Examiner*—David A. Scherbel
*Assistant Examiner*—Winnie Yip
*Attorney, Agent, or Firm*—Ronald P. Kananen

[57] ABSTRACT

A structure of a pedal such as an acceleration pedal, a clutch pedal, or a brake pedal for a vehicle in provided. This structure includes generally a pedal pad detachably supported by a pedal arm, a housing integrally formed on the pedal pad, and a mass having a preselected weight for absorbing vibration transmitted through the pedal arm. The mass includes first and second sections, the first section is inserted into the housing to be retained in the pedal pad and the second section extends outside the housing. Thus, various types of masses having different widths in the exposed second section can be attached to the pedal pad to adjust the resonance frequency of the pedal arm.

7 Claims, 2 Drawing Sheets

VIBRATION PROOFING STRUCTURE OF PEDAL FOR VEHICLE

BACKGROUND OF THE INVENTION

1. Technical Field

The present invention relates generally to the structure of a pedal, such as an accelerator, clutch, or brake pedal for a vehicle. More particularly, the invention relates to a vibration proofing pedal structure for a vehicle to which a mass having a preselected weight is attached to absorb vibration transmitted from the engine and/or the transmission so as to preventing such vibrations from being transmitted to the driver.

2. Background Art

Usually, an accelerator pedal for a vehicle serves to adjust an opening of a throttle valve by depressing a pedal pad to control engine speed. The pedal pad is attached to a lower end portion of a pedal arm which is pivotably supported by a vehicle body through a bracket and an upper end portion of which is connected to an operation rod extending to the engine. A clutch pedal has the same construction as that of the acceleration pedal and is adapted for engaging or disengaging power between the transmission and the engine.

However, in the above pedal structure, since the pedal is connected to the engine via the operating rod, vibration tends to be transmitted to a drivers foot while the vehicle is running, thereby frequently giving an unpleasant feeling to the driver.

In order to absorb this pedal vibration, a pedal arm is generally well known in the art on which a mass is welded to prevent the arm from vibrating. In this structure, an additional manufacturing step is necessary for welding the mass to the pedal arm. Additionally, due to variations in manufactured pedal arms, the resonance frequencies thereof are different from each other as are the differences in the resonating frequencies of various engines, dependent on the type of vehicle.

Thus, to attach a mass suitable for absorbing the proper vibration frequencies for various types of vehicles, masses having different weights are accordingly necessary. In manufacture, this results in a disadvantage in that a uniform mounting operation cannot be easily adopted.

SUMMARY OF THE INVENTION

It is accordingly one object of the present invention to avoid the disadvantages of the prior art.

It is another object of the invention to provide a vibration proofing structure for facilitating mounting a mass on a pedal which is suitable for absorbing a resonance frequency of a pedal arm.

According to one aspect of the present invention, there is provided a structure of a pedal for a vehicle which comprises a pedal pad attached to a pedal arm, a mass having a preselected weight for adjusting a resonance frequency of the pedal arm to prevent vibration transmitted to the pedal arm from being transmitted to the pedal pad, and a retaining means for retaining part of the mass to the pedal pad.

In the preferred mode, the retaining means is a housing integrally formed on the pedal pad. The mass includes first and second sections, the first section being fitted into the housing to be retained to the pedal pad, the second section extending outside the housing.

A hook means may be provided for engaging an edge of the second section of the mass to securely retain the mass to the pedal. The hook means may be located between the housing and the pedal arm so as to prevent the mass from contacting with the pedal arm whereby noise induced by the contact of the mass with the pedal arm is prevented from occurring. The hook means may be made of an elastic material to provide flexibility so as to allow it to swing about a portion connected to the pedal pad for facilitating insertion of the mass into the housing during assembly.

According to another aspect of the invention, there is provided a vibration proofing structure of a pedal for a vehicle which comprises a pedal pad, a retaining means for detachably retaining the pedal pad to a pedal arm, a housing, integrally formed on the pedal pad, located adjacent the pedal arm retained on the pedal pad by the retaining means, and a mass inserted into the housing, the mass provided with first and second sections, the first section having a first geometry corresponding to a dimension of inside of the housing to be fitted into the housing so as to be held to the pedal pad, the second section extending outside the housing, having a second geometry and providing additional weight to the first section so as to vary a resonance frequency of the pedal arm to prevent vibration transmitted to the pedal arm from being transmitted to the pedal pad.

BRIEF DESCRIPTION OF THE DRAWINGS

The present invention will be understood from the detailed description given hereinbelow and from the accompanying drawings of the preferred embodiments which are given for explanation and understanding only and are not intended to imply limitations to the invention.

DESCRIPTION OF THE PREFERRED EMBODIMENT

Figure 1:
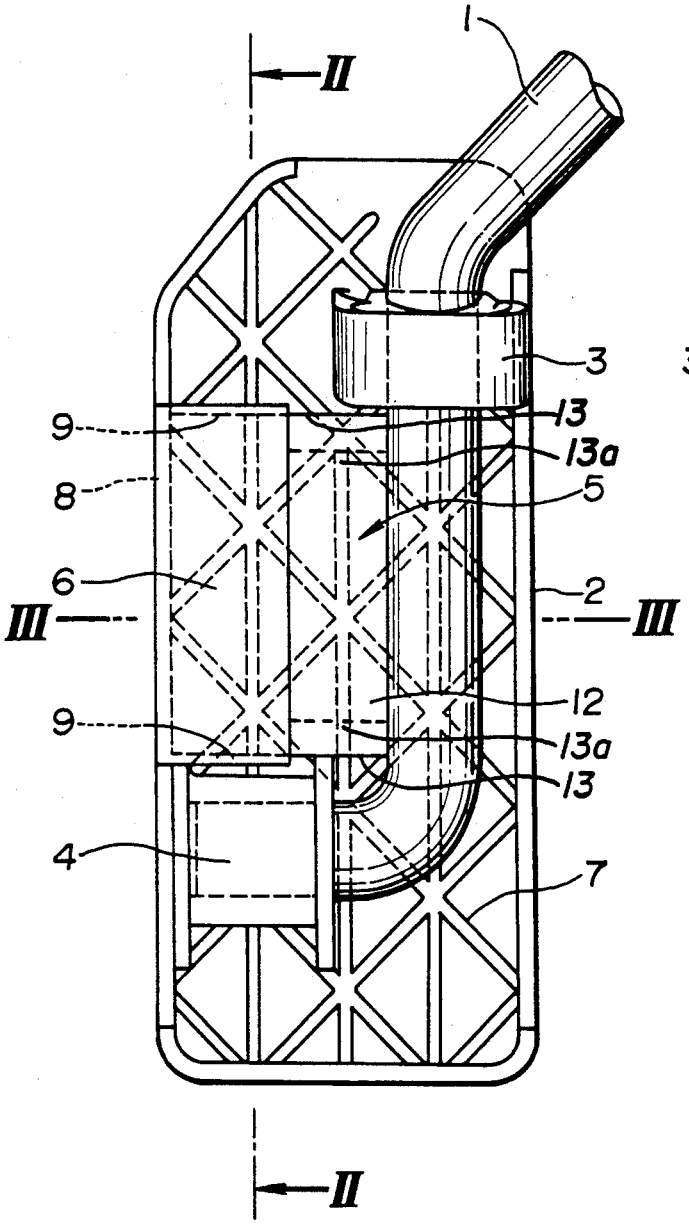
FIG. 1 is a rear elevation which shows a structure of an acceleration pedal according to the present invention.
Figure 2:
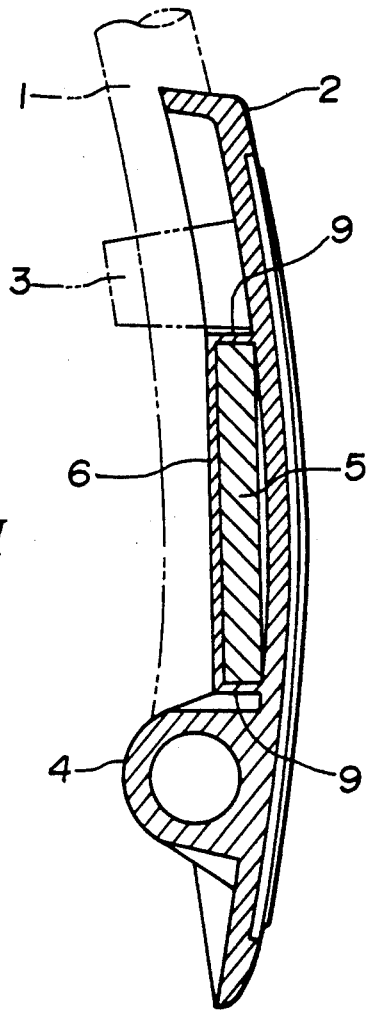
FIG. 2 is a cross sectional view taken along the line II—II in FIG. 1.
Figure 3:
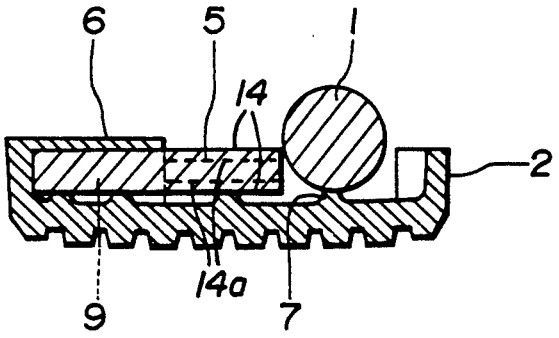
FIG. 3 is a cross sectional view taken along the line III—III in FIG. 1.

Referring to the drawings, particularly to FIGS. 1 and 2, a structure of an accelerator pedal for a vehicle according to the present invention is shown. This structure includes generally a pedal arm 1, a pedal pad 2 made of a synthetic material, and a mass 5. The pedal pad 2 has a fastener 3 and a pedal arm insertion hole 4 which are integrally formed on the back surface of the pedal pad 2 for detachably attaching the pad to an L-shaped end portion of the pedal arm 1. The mass 5 is detachably inserted into a pocket portion 6 integrally formed on the back surface of the pedal pad 2. The pocket portion 6 extends from a rib reinforcement 8 which is formed around an edge of the back surface of the pedal pad toward the pedal arm 1 to form a rectangular housing C-shaped in cross-section including side walls 9 to open to the pedal arm 1. The mass 5 is made of a rectangular iron block which has a preselected width allowing it to be fitted into the pocket portion 6. Therefore, mounting the mass 5 to the pedal pad 2 is accomplished by inserting it into the pocket portion 6 from the opening thereof after which the pedal arm 1 is engaged with the hole 4 and is then retained in place by the fastener 3. It will be appreciated that with the above attaching sequence, the mass 5 is easily attached to the pedal pad 3 with firm engagement with the side walls 9, rib reinforcements 7, and the pedal arm 1 as shown in FIG. 3.

Figure 4:
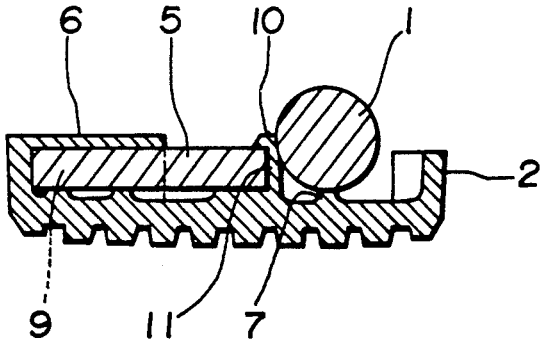
FIG. 4 is a cross section view of a pedal which shows an alternate embodiment of the present invention.

For attaching the mass, an adhesive may be used. Alternatively, a center wall 11, as shown in FIG. 4, may be provided between the mass 5 and the pedal arm 1 on the pedal pad 2 which is relatively thin to provide flexibility so as to allow it to swing somewhat about a portion connected to the pedal pad for facilitating insertion of the mass into the pocket portion 6 during assembly. Additionally, the center wall 11 has a hook or stopper 10 for engaging an edge of the mass to hold it securely, thereby preventing it from falling due to variation in temperature or secular distortion and preventing metal contact between the mass and the pedal arm from occurring to reduce noise induced by the metal contact.

For geometry of the mass 5, while an area completely inserted into the pocket portion 6 is restricted dependent on a dimensions of inside the pocket portion, an exposed area 12 thereof may be changed in wall thickness or width to adjust the entire weight thereof so as to vary a resonance frequency of the pedal arm 1. A variation in width between the boundaries 13, 13 of the mass 5 is shown by phantom lines 13*a*, 13*a* in FIG. 1. Similarly, a variation in thickness between boundaries 14, 14 of the mass 5 is shown by phantom lines 14*a*, 14 *a* in FIG. 3. It will be appreciated that masses having different weights can be attached to the pedal pad 2 easily to adjust the resonance frequency of the pedal arm 1, preventing vibration from the engine or from the transmission from being transmitted to a driver.

While the present invention has been disclosed in terms of the preferred embodiment in order to facilitate better understanding thereof, it should be appreciated that the invention can be embodied in various ways without departing from the principle thereof. Therefore, the invention should be understood to include all possible embodiments and modifications to shown embodiments which can be embodied without departing from the principle of the invention as set out in the appended claims.

What is claimed is:

1. A pedal assembly for a vehicle comprising:

a pedal pad attached to a pedal arm on a back surface of said pedal pad;

a housing, provided on the back surface of said pedal, projecting from the back surface, said housing being transversely offset from the pedal arm with a given distance therebetween and having an opening oriented to said pedal arm;

a mass having a preselected weight for adjusting a resonant frequency of the pedal arm for preventing vibrations transmitted to the pedal arm from reaching said pedal pad, said mass including first and second sections, wherein the first section is fitted substantially entirely into the inside of said housing for retention to said pedal pad, and wherein the second section extends outside of the housing and is located between said housing and the pedal arm; and hook means extending upwardly from the pedal pad and being located between the second section of the mass and the pedal arm.

2. A structure as set forth in claim 1, wherein said hook means further comprises means for engaging with an edge of the second section of said mass to securely retain said mass to said pedal.

3. A structure as set forth in claim 1, wherein said hook means is located between said housing and the pedal arm so as to prevent said mass from contacting with the pedal arm whereby noise induced by the contract of said mass with the pedal arm is prevented from occurring.

4. A structure as set forth in claim 3, wherein said hook means is made of an elastic material to provide flexibility so as to allow said hook means to swing about a portion connected to said pedal pad for facilitating insertion of said mass into said housing during assembly.

5. A structure as set forth in claim 1, further comprising a rib reinforcement formed on a surface of said pedal pad, a surface of said mass contacting the rib reinforcement.

6. A pedal assembly as set forth in claim 1, wherein said housing has a rectangular shape and is integrally formed on said pedal pad.

7. A pedal assembly as set forth in claim 1, wherein the first section of said mass has a first geometry corresponding to the inside dimensions of said housing so that the mass fits into said housing and is held to said pedal, and the second section has a second geometry and provides additional weight to the first section to vary the resonant frequency of the pedal arm.

* * * * *

UNITED STATES PATENT AND TRADEMARK OFFICE

CERTIFICATE OF CORRECTION

PATENT NO. : 5,186,076

DATED : February 16, 1993

INVENTOR(S) : Yoshimasa Kataumi; Yoshinobu Kondo

It is certified that error appears in the above-identified patent and that said Letters Patent is hereby corrected as shown below:

On the title page, item [22] Filed: should read

--Filed: July 25, 1990--.

Signed and Sealed this

Thirtieth Day of November, 1993

Bruce Lehman

*Attest:*

BRUCE LEHMAN

*Attesting Officer*

*Commissioner of Patents and Trademarks*